US010260285B2

(12) United States Patent
Kim

(10) Patent No.: US 10,260,285 B2
(45) Date of Patent: Apr. 16, 2019

(54) SAFETY DEVICE AND EMERGENCY ESCAPE DEVICE FOR HIGH-RISE BUILDING

(71) Applicants: FINE DNC CO., LTD., Asan-si, Chungcheongnam-do (KR); Jung Yeon Lee, Yongin-si, Gyeonggi-do (KR)

(72) Inventor: Chong Chan Kim, Suwon-si (KR)

(73) Assignees: FINE DNC CO., LTD., Asan-si, Chungcheongnam-do (KR); Jung Yeon Lee, Yongin-si, Gyeonggi-do (KR)

( * ) Notice: Subject to any disclaimer, the term of this patent is extended or adjusted under 35 U.S.C. 154(b) by 28 days.

(21) Appl. No.: 15/568,172

(22) PCT Filed: Nov. 30, 2016

(86) PCT No.: PCT/KR2016/013938
§ 371 (c)(1),
(2) Date: Oct. 20, 2017

(87) PCT Pub. No.: WO2018/070602
PCT Pub. Date: Apr. 19, 2018

(65) Prior Publication Data

US 2018/0298692 A1 Oct. 18, 2018

(30) Foreign Application Priority Data

Oct. 13, 2016 (KR) ..... 10-2016-0132694

(51) Int. Cl.
*E06C 9/10* (2006.01)
*A62B 5/00* (2006.01)
(Continued)

(52) U.S. Cl.
CPC ..... *E06C 9/10* (2013.01); *A62B 5/00* (2013.01); *E04F 11/062* (2013.01);
(Continued)

(58) Field of Classification Search
CPC ... E06C 9/10; E06C 7/183; A62B 5/00; E04F 11/062; E04F 2011/1868
See application file for complete search history.

(56) References Cited

U.S. PATENT DOCUMENTS 573,165 A * 12/1896 Scherrer
1,101,714 A * 6/1914 Rauber ..... E06C 9/10 182/163

(Continued)

FOREIGN PATENT DOCUMENTS

KR 10-2004-0094450 A 11/2004
KR 10-0845297 B1 7/2008

(Continued)

*Primary Examiner* — Alvin C Chin-Shue
(74) *Attorney, Agent, or Firm* — Rabin & Berdo, P.C.

(57) ABSTRACT

The present invention relates to an integrated folding safety handrail and outdoor escape stairs for high-rise buildings and an emergency escape device which are applied to high-rise buildings such as safety handrails for preventing falling from a movable passage exposed to apartment houses such as apartments or office buildings, and the outside and is applied as a substitute for safety handrails in high-rise buildings or outdoor ground clearance 3 m or more which is usually used as a safety handrail for falling prevention and so that an escaping person in the high-rise building escapes outside or safely escapes to a lower floor in case of emergency such as fire, terror, and disaster.

Particularly, the present invention relates to an integrated folding safety handrail and outdoor escape stairs for high-rise buildings and an emergency escape device, including a fence unit 1 in which an entrance unit 10 and a safety fence unit 20 are integrated; and a sliding stair unit 30 formed at a lower end of the fence unit 1.

20 Claims, 6 Drawing Sheets

(51) Int. Cl.
*E04F 11/06* (2006.01)
*E04F 11/18* (2006.01)
*E06C 7/18* (2006.01)

(52) U.S. Cl.
CPC ..... *E04F 11/181* (2013.01); *E06C 7/183* (2013.01); *E04F 2011/1868* (2013.01)

(56) References Cited

U.S. PATENT DOCUMENTS 3,997,026 A * 12/1976 Riehlmann ..... E06C 1/125 182/96
4,090,585 A * 5/1978 Laub ..... A62B 5/00 182/113

FOREIGN PATENT DOCUMENTS

| | | | | |
|---|---|---|---|---|
| KR | 10-0968162 | B1 | 7/2010 | |
| KR | 10-1017133 | B1 | 2/2011 | |
| KR | 10-1562205 | B1 | 10/2015 | |
| WO | WO-9732107 | A1 * | 9/1997 | ..... E06C 9/06 |
| WO | WO-2011/111998 | A2 * | 9/2011 | |

* cited by examiner

[FIG. 1]
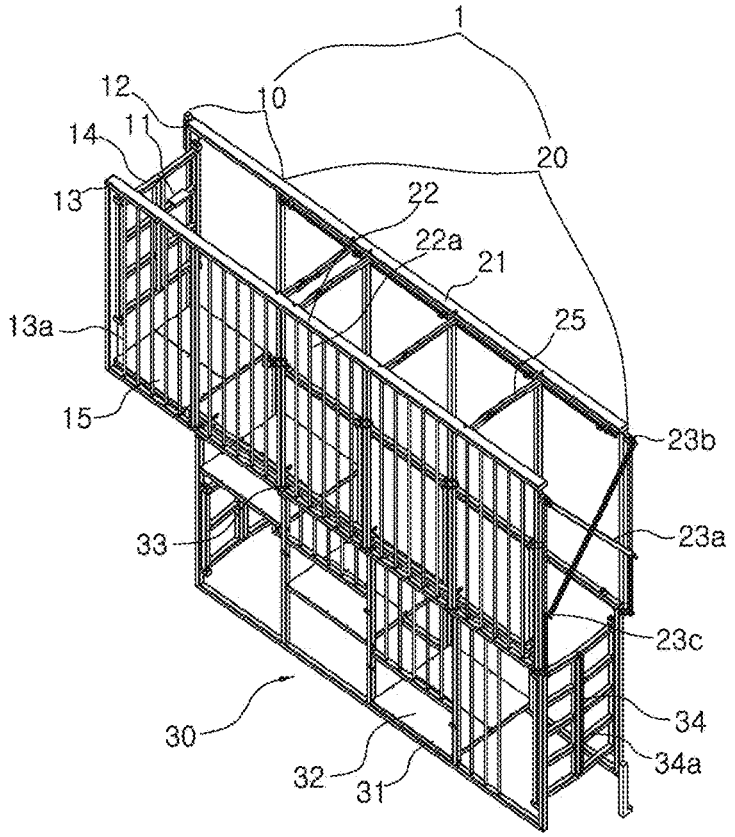
[FIG. 2]
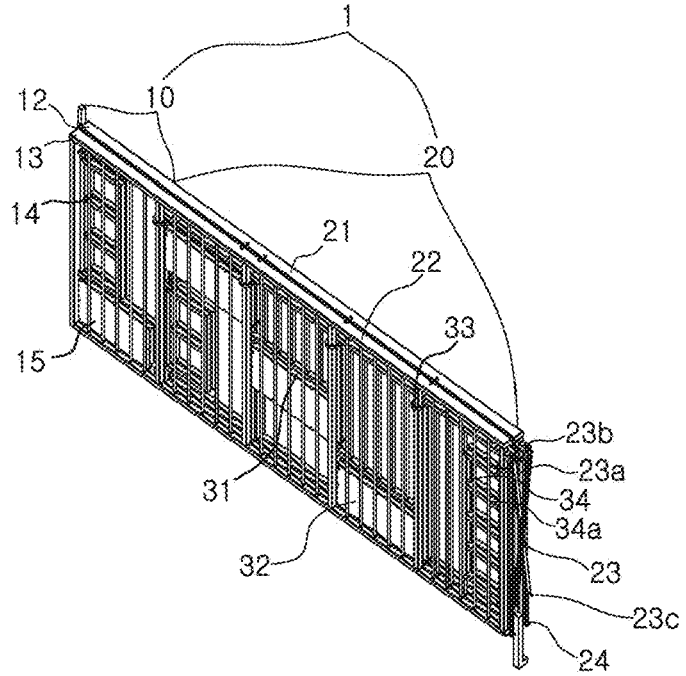

[FIG. 3]
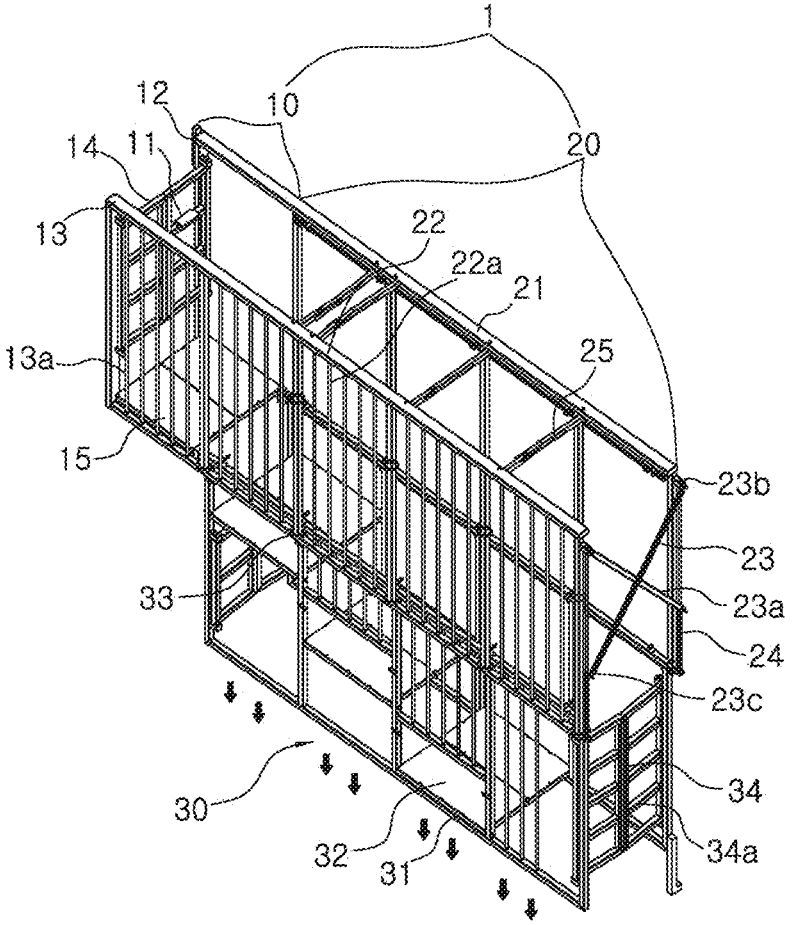

[FIG. 4]
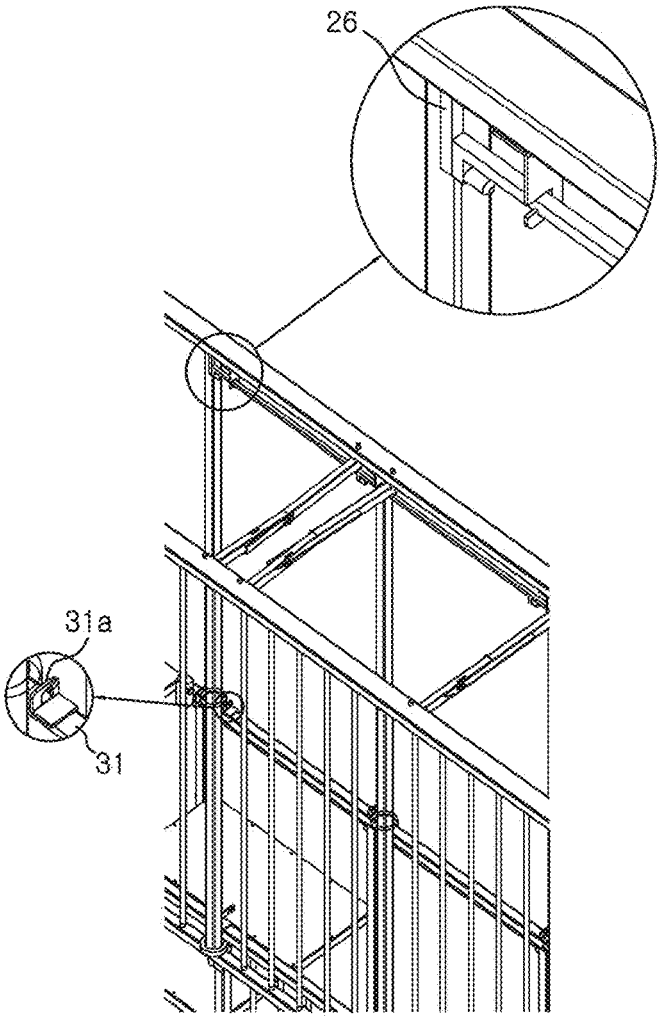
[FIG. 5]
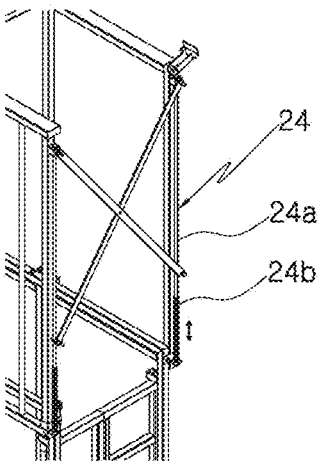

[FIG. 6]
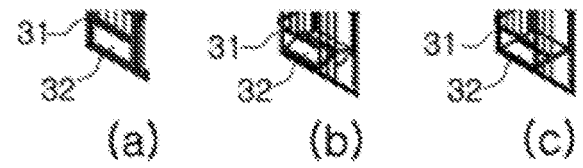
[FIG. 7]
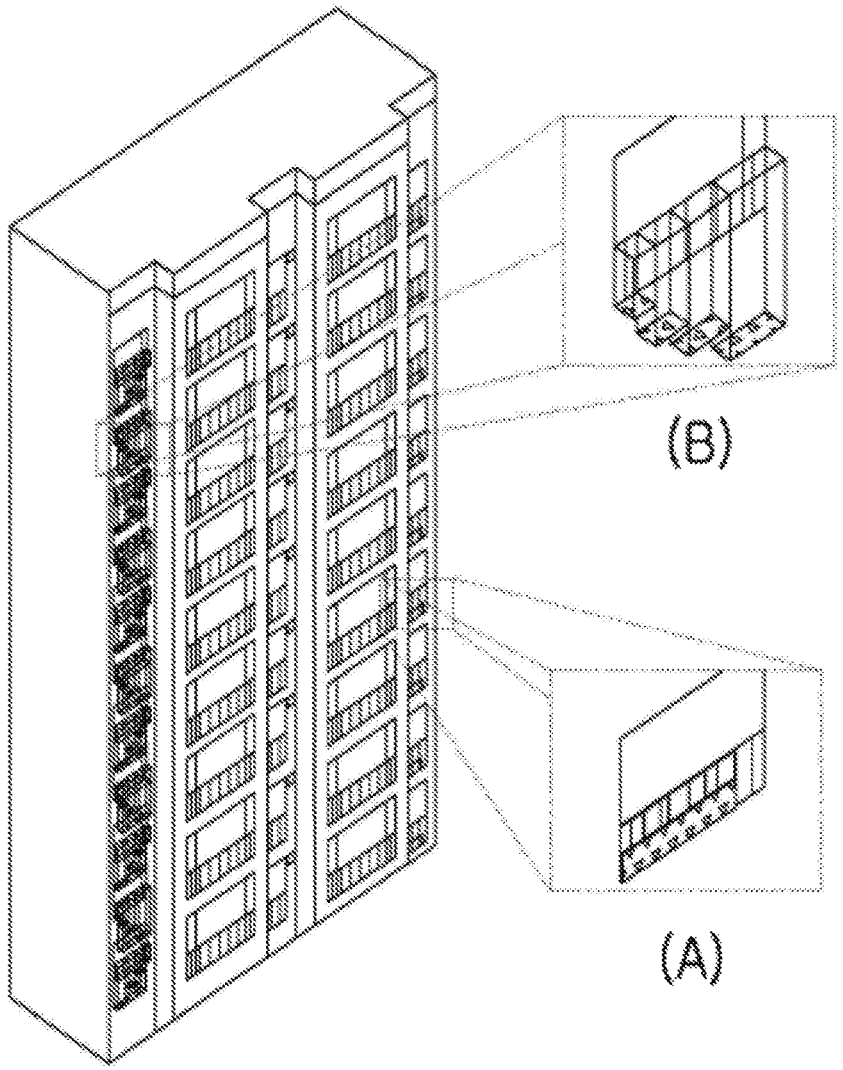

[FIG. 8]
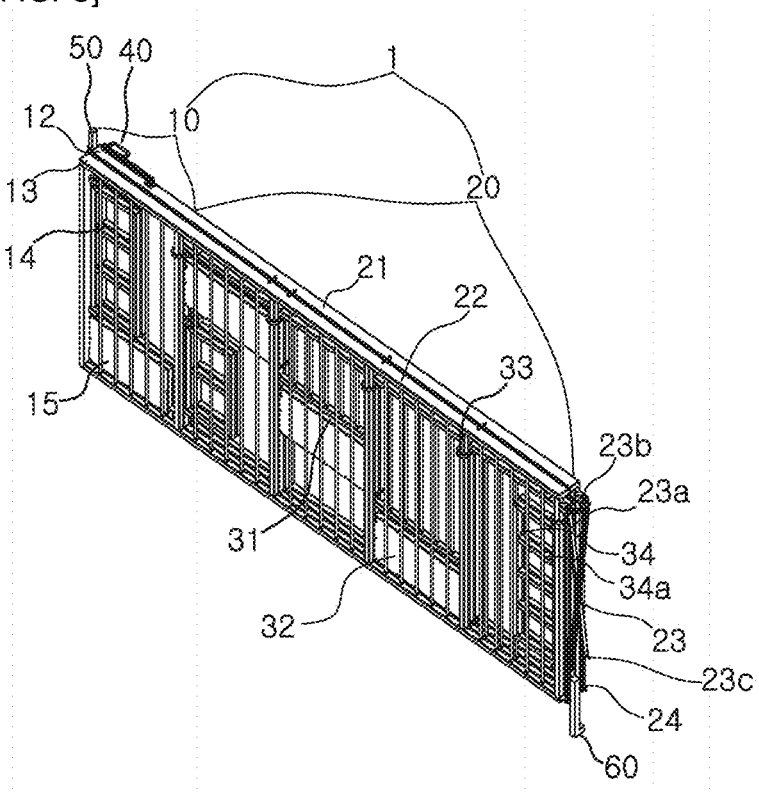

[FIG. 9]
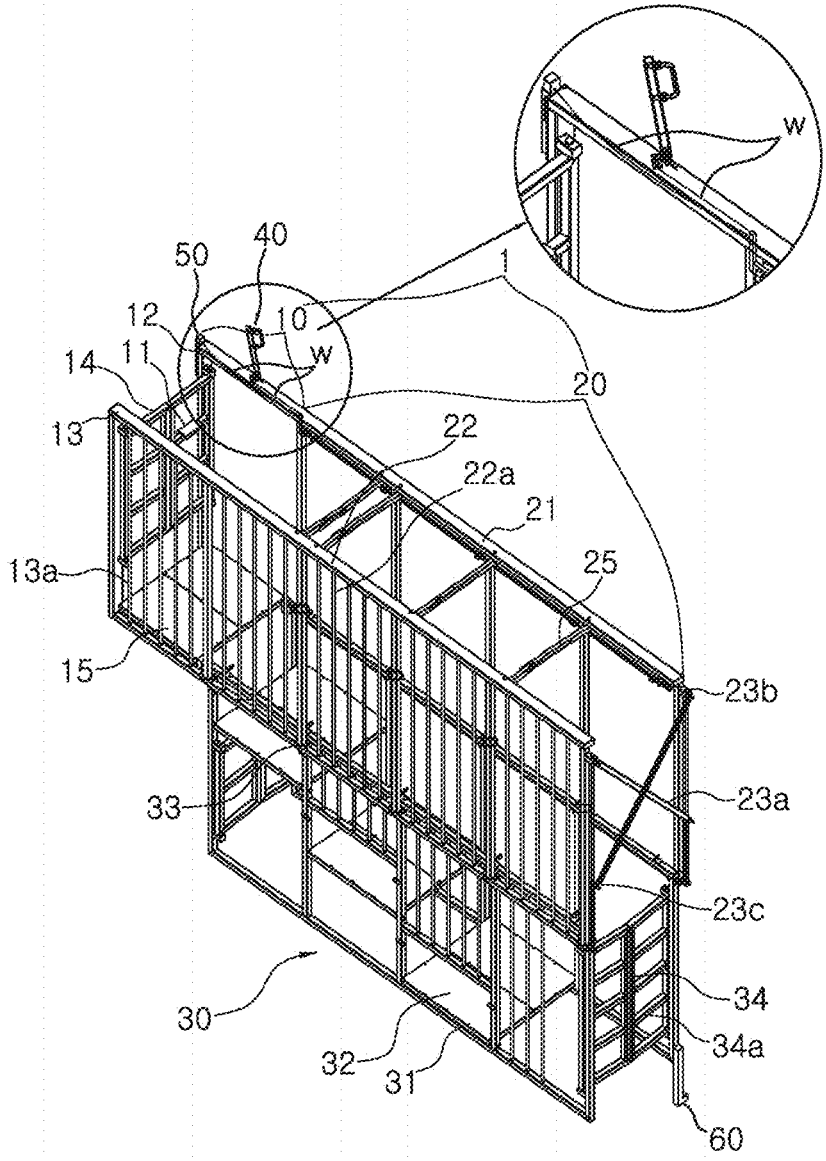

SAFETY DEVICE AND EMERGENCY ESCAPE DEVICE FOR HIGH-RISE BUILDING

TECHNICAL FIELD

The present invention relates to an emergency escape device combined with a folding safe handrail which is applied to high-rise buildings of 3 m or more from the ground, such as safety handrails for falling prevention at apartment houses such as high-rise building apartments or office buildings, and is applied to a high-rise handrail or high-rise safety handrail of a building which is usually used as a safety handrail for falling prevention and so that an escaping person in the high-rise building escapes outside or safely escapes to a lower floor in case of emergency such as fire, terror, and disaster.

Particularly, the present invention relates to an integrated folding safety handrail and outdoor escape stairs for high-rise buildings and an emergency escape device, including a fence unit in which an entrance unit 10 and a safety fence unit 20 are integrated; and a sliding stair unit 30 formed at a lower end of the fence unit 1.

BACKGROUND ART

As the society develops, the centralization of the city is becoming more and more intensive, and office buildings and apartment buildings in the city are becoming higher. However, such high-rise buildings are increasingly exposed to fire and external hazards, and disasters are becoming larger.

The reason is that due to the increase in installation of electronic equipment and electric heating appliances, cooling and heating equipment and other electronic appliances in many places of modern high-rise buildings, the probability of fire increases day by day due to heating of the electric heating appliances, electrical overload, short-circuit, lighting, natural disaster, and the like.

However, when an emergency situation such as a fire occurs in such a high-rise or super-rise building and the emergency staircase is closed, people inside the building need to passively wait for a skyscraper ladder which is an escape device without active escaping equipment and devices, and the skyscraper ladder can not approach a certain floor or more or is very limited to access the floor within a short time. Also, in the event of a disaster in outdoor and indoor shopping malls or concert halls, a stadium, and the like, where people concentrate, the danger is multiplied by the bottleneck of the evacuation passage when many people are concentrated to the emergency stairs at the same time.

For this reason, it is very limited or almost impossible to escape to the outside from the inside of a building when an emergency occurs in a skyscraper or a concert hall, and when an emergency such as a fire occurs inside the skyscraper all over the world, many people will be injured repeatedly.

In order to solve such a problem, escaping methods for apartment houses have been proposed variously in the Building Law to escape when emergency situations such as fire occur. A representative example is that a fire shelter needs to be installed indoors to be blocked from the outside when a fire occurs.

However, these indoor fire escape facilities are not intended to escape when a fire occurs, but only to passively escape temporarily from the fire scene until the fire suppression and saving are achieved.

In order to solve this problem, a sprinkler is mandatorily installed in high-rise buildings, fire extinguishers are mandatorily installed or emergency stairs are installed, and thus fire escape facilities are constructed on each floor. In addition, there is disclosed a technique in which a fire escape facility constructed for each floor is provided with a device capable of continuously escaping toward the lower floor, but the device is provided in a building and the rapid escape is very limited.

In addition, the proposed escape devices can escape downward from the upper floor to the lower floor, but even if there is no urgent situation in the upper floor, there is a risk of easily entering the lower floor. There is a disadvantage in that it is difficult for a liver to install a locking device in the entrance of the escape passage for preventing invasion of privacy to use the escape device in an emergency situation.

In addition, in the case of such an indoor fire escape facility, it is necessary to design a separate space when designing the apartment house. As a result, it is inconvenient that the living space of the resident is reduced after completion, and there are many cases where the escape space and the escape facility are not equipped in the already completed building.

In order to overcome the above-mentioned problem of the escape facility, there has been proposed an escape facility or escape device installed outside the building. However, mostly, it is difficult to verify their effectiveness, and due to its structural characteristic, a lot of volume is occupied and mostly, it is reluctant to install and use the escape device.

A representative example of such an outdoor type escape device is proposed in Korean Patent Registration No. 10-1562205 (Safety fire escape system in high-rise building, registered on Oct. 15, 2015). However, in the case of the above-described technique, the mechanical impact is applied to the outer wall of the lower floor due to the centrifugal force during the operation for escaping in case of emergency, and there is a problem in that the escaping person of the lower floor may be hit.

In addition, there is a risk that the escaping person will fall to the opened outside of the escape device because the safety compartments such as fences of a plurality of escape devices are not properly installed in case of emergency, and there is a problem that the escaping person is reluctant to escape downward in the case of acrophobia and the like.

DISCLOSURE

Technical Problem

In order to solve the above problems, an object of the present invention is to provide an integrated folding safety handrail and outdoor escape stairs and an escape device so that an escaping person may safely escape so as not to be exposed to the outside of the escape device when the escape device is unfolded and operates for escaping in case of emergency.

Another object of the present invention is to provide integrated folding safety handrail and outdoor escape stairs and an emergency escape device capable of minimizing a mechanical impact applied to an escape device when unfolding for escaping and normally serving as a safety rail for falling prevention. In addition, safety handrails such as concert halls and stadiums where people gather together or some safety handrails in the moving route can be replaced with the present invention, thereby providing a variety of escape routes to a large number of people in the event of an emergency disaster. In addition, the present invention is configured to be continuously unfolded from a high-rise position to a ground floor or a position to escape of the escaping person without using external power.

Yet another object of the present invention is to provide an integrated folding safety handrail and outdoor escape stairs and an emergency escape device, including a fence unit in which an entry unit 10 and a safety fence unit 20 are integrated; and a sliding stair unit 30 formed at a lower end of the fence unit 1, thereby facilitating site assembly during installation and corresponding to directionality according to a site situation by combining respectively component parts.

Technical Solution

An exemplary embodiment of the present invention provides a fence unit 1 in which an entrance unit 10 and a safety fence unit 20 are integrated; and a sliding stair unit 30 provided inside the safety fence unit 20 and installed so that escape stairs are unfolded to escape downward and slide, in which the entrance unit 10 is installed on the outside of the high-rise building or a high-rise outdoor safety fence and unfolded and protrudes to form an escape space on the outer wall of the building in order to escape to the outside of the building from the inside which is an escape place in case of emergency, in an emergency escape device which is normally used as a handrail for falling prevention and used for evacuation and escape in case of emergency, and the safety fence unit 20 is extended from the entrance unit 10 and unfolded to form a space to escape downward.

The entrance unit 10 may include a coupling frame 12 attached on the outer well of the building, a fence plate 13 corresponding to the coupling frame 12, and a folded fence 14 coupled to the fence plate 13 and one side of the coupling frame 12 to be folded and further include an unfolding footplate 15 coupled to the inner lower end, and the folding fence 14 may have a hinge at the center and be formed so that a pair of rectangular frames are coupled to each other based on the hinge and a folding downward stair 11 may be coupled to each rectangular frame, so that an escaping person may move downward when the escaping person escapes downward from the upper floor to the lower floor of the multi-family houses.

The safety fence unit 20 may include a fastening plate 21 coupled to the outer wall side of the building, a safety fence 22 corresponding to the fastening plate 21 and provided to be unfolded and spaced apart from the outer wall of the building, a support portion 23 provided on a side opening portion of the safety fence 22 and the fastening plate 21, a guide rod 24 provided so that the support portion 23 may move when the safety fence 22 is unfolded, a hinge bar 25 provided at the upper side of the safety fence 22 and the fastening plate 21, and locking protrusions 26 extended in the longitudinal direction of the safety fence unit 20 to be formed at predetermined intervals, and the sliding stair unit 30 may be configured by coupling a pair of sliding fences 31 and a folding stair 32 provided inside the sliding fence 31, and a folding fence 34 provided on an opened surface of the pair of sliding fences 31 and a locking portion 31*a* provided on one side of the sliding fences 31.

The folding fence 34 may be formed to be coupled to a pair of rectangular frames based on the hinge to be folded based on the hinge, and a plurality of horizontal bars 34*a* may be formed in a ladder shape in the pair of rectangular frames, and the horizontal bar 34*a* may prevent the escaping person from falling on the opened surface of the pair of sliding fences 31 and be held and move downward, when the escaping person escapes downward. In addition, the support portion 23 to easily unfold and support the safety fence 22 in the case of emergency such as firing may include a support bar 23*a* configured in a scissor form in which a pair of bars are hinge-coupled, a coupling hinge 23*b* which is coupled to the fastening frame 21 and a part of the upper portion of the safety fence 22, respectively, so that one end of the support bar 23*a* is rotatable, and a transfer hinge 23*c* by which the other end of the support bar 23*a* is extrapolated into the guide rod 24 provided at the fastening frame 21 and one side of the safety fence 22 to be hinge-coupled to be movable.

The transfer hinge 23*c* may move along the guide rod 24 to be supported when the scissor-shaped support bar 23*a* is unfolded, and an elastic member 24*b* is further included at one side of the guide rod 24, and when folding, the transfer hinge 23*c* may press the elastic member 24*b*, and when unfolding, the transfer hinge 23*c* may be transferred upward by the pressed elastic force to be easily unfolded.

A control unit 40 for unfolding the emergency escape device may be provided at one side of the entrance unit 10, a push unit 50 may be configured at one end of the entrance unit 10 and a punch unit 60 may be configured at one end of the safety fence unit 20, and the control unit 40 and the locking device 26 may be connected to each other by a wire w, and the wire w may be pulled by pulling the control unit 40 to pull the locking protrusions and then while the locking protrusions and the sliding fence 31 are separated from each other, the sliding stair unit 30 may descend.

When the fence units 1 and the slide stair units 30 are installed on a plurality of floors, the locations of the entrance units 10 may be alternately arranged for each floor, and when the slide stair unit 30 descends, the punch unit 60 configured in the slide stair unit 30 may hit the push unit 50 configured in the entrance unit 10 to unfold the fence unit 1 and the slide stair unit 30 at the lower floor and then the fence units 1 and the slide stair units 30 at the plurality of floors may be continuously unfolded.

Advantageous Effects

According to the present invention, an emergency escape device combined with an integrated folding safety handrail for high-rise buildings is provided, and when the escape device is unfolded in case of emergency, an escaping person safely escapes without being exposed to the outside of the emergency device and it is effective to minimize the fear of the escaping person with phobias and minimize the damage of humans by rapid evacuation.

Further, (a) when the escape device is unfolded, a mechanical impact applied to the device is reduced to enhance the lifespan and safety, (b) a fence unit 1 in which an entrance unit 10 and a safety fence unit 20 are integrated and a sliding stair unit 30 configured at a lower end of the fence unit 1 are included, and thus, it is possible to easily assemble respective parts at the time of installation so that cost and time required for installation and assembly can be reduced according to the situation of the site.

In addition, when the escaping person wants to escape to the ground floor, the integrated folding safety handrail and outdoor escape stairs can be configured to be continuously automatically unfolded from the location of the escaping person to the ground. Alternatively, a person applying the present invention to the buildings autonomously selects the location which is automatically and continuously unfolded in order to actively escape in the case of firing and emergency, thereby promoting efficiency of the escape.

DESCRIPTION OF DRAWINGS

FIG. 1 is a perspective view of the present invention.

FIG. 2 is a perspective view of the present invention which is folded.

FIG. 3 is an exemplary view of an operating state of the present invention.

FIG. 4 is a partially enlarged view for illustrating a locking device 26 according to the present invention.

FIG. 5 is a partially enlarged view for illustrating an unfolding operation according to the present invention.

FIG. 6 is an exemplary view illustrating an operation of a folded stair 32 according to the present invention.

FIG. 7 is an exemplary view for illustrating an example in which the present invention is installed and unfolded in a continuous operation.

FIGS. 8 and 9 are exemplary views illustrating another operating state according to the present invention.

MODES OF THE INVENTION

The present invention will be described in detail with reference to the accompanying drawings.

FIG. 1 is a perspective view of the present invention, FIG. 2 is a perspective view of the present invention which is folded, and FIG. 3 is an exemplary view of an operating state of the present invention.

FIG. 4 is a partially enlarged view for illustrating a locking device 26 according to the present invention, FIG. 5 is a partially enlarged view for illustrating an unfolding operation according to the present invention, and FIG. 6 is an exemplary view illustrating an operation of a folded stair 32 according to the present invention.

When describing the present invention in detail with reference to FIGS. 1 to 6, an integrated folding safety handrail and outdoor escape stairs and an emergency escape device of the present invention are attached to an outer wall of an apartment house and are normally installed in a folded state with a fall-prevention rail on a balcony or the like and then unfolded in case of emergency and used as the emergency escape device.

The integrated folding safety handrail and outdoor escape stairs for high-rise buildings and the emergency escape device includes a fence unit 1 in which an entrance unit 10 protruding from an outer wall of the building to form an escape space to escape to an outside or a lower floor of the building in a moving path of an inside or a high floor which is an escape place in case of emergency such as firing is integrated with a safety fence unit 20 adjacent to the entrance unit 10 and forming a space for escaping downward; and a sliding stair unit 30 provided inside the safety fence unit 20 and installed so that escape stairs are unfolded to escape downward and slide.

The entrance unit 10 includes a coupling frame 12 attached on the outer wall of the building, a fence plate 13 corresponding to the coupling frame 12, and a folding fence 14 coupled to the fence plate 13 and one side of the coupling frame 12 to be folded and further includes an unfolding footplate 15 coupled to the inner lower end.

In this case, the unfolding footplate 15 is formed to be folded at a center by a hinge and both ends are hinge-coupled to the coupling frame 12 and the lower end of the fence plate 13, respectively.

The entrance unit 10 configured above is formed as a structure having a space at the inside by coupling the coupling frame 12 and the side of the fence plate 13 with the folding fence 14 and coupling the coupling frame 12 and the lower end of the fence plate 13 by the unfolding footplate 15.

Herein, the folding fence 14 has a hinge at the center and is formed so that a pair of rectangular frames are coupled to each other based on the hinge and a folding downward stair 11 is coupled to each rectangular frame, so that an escaping person may move downward when the escaping person at a high-riser building or a high floor escapes downward from the upper floor to the lower floor.

As a result, small children as wall as adults may easily escape downward.

In more detail, the folding fence 14 is located to correspond to the end of the emergency escape device installed at each of many floors and used when the escaping person moves downward to move from the upper floor to an emergency escape device installed at the next floor.

The safety fence unit 20 extended at the side of the entrance unit 10 includes a fastening plate 21 coupled to the outer wall side of the building, a safety fence 22 corresponding to the fastening plate 21 and provided to be unfolded and spaced apart from the outer wall of the building, a support portion 23 provided on a side opening portion of the safety fence 22 and the fastening plate 21, a guide rod 24 provided so that the support portion 23 may move when the safety fence 22 is unfolded, and a hinge bar 25 provided at the upper side of the safety fence 22 and the fastening plate 21.

Further, a plurality of vertical bars 22*a* is further provided at one side of the safety fence 22 to prevent the escaping person from falling.

Further, a plurality of sliding stair units 30 having different entire lengths is provided inside the safety fence unit 20, and the sliding stair units 30 are located inside the safety fence unit 20 and then unfolded with the safety fence unit 20 when unfolded for escaping in case of emergency and down from the safety fence unit 20 to serve as emergency stairs.

In this case, the sliding stair unit 30 includes a pair of sliding fences 31 and a folding stair 32 provided inside the sliding fence 31, and a folding fence 34 which is coupled with an opened surface of the sliding fence 31.

In this case, the folding fence 34 is formed to be coupled to a pair of rectangular frames based on the hinge to be folded based on the hinge, and a plurality of horizontal bars 34*a* is formed in a ladder shape in the pair of rectangular frames.

The horizontal bar 34*a* is provided to allow the escaping person to hold while escaping downward and move downward and prevents the escaping person from falling on the opened surface of the pair of sliding fences 31.

The sliding fence 31 may be formed in a stepped shape with a plurality of vertical bars having different entire lengths in a stepwise manner.

In addition, the sliding fence 31, which is spaced apart from the outer wall of the building and unfolded, may further include a safety bar for preventing the escaping person from falling.

More specifically, the length of the vertical bar is increased as the distance from the entrance unit 10 increases, so that the height of the vertical bar is lowered stair by stair.

Accordingly, vertical bars having different heights are arranged in sequence to maintain a downward shape.

A deceleration coupling hole 33 is further provided at one side of the sliding fence 31. The deceleration coupling hole 33 is extrapolated into a plurality of vertical bars 22*a* provided in a longitudinal direction of the safety fence 22 to ascend in the longitudinal direction of the vertical bars 22*a* and supported by the horizontal bar coupled to the lower end of the vertical bar 23*a* to be prevented from moving downward by a predetermined distance or more.

Such a sliding fence 31 has a plurality of stairs which are formed integrally and descend to operate simultaneously.

Herein, as such, the deceleration coupling hole 33 is provided to attenuate descending impact applied to the safety fence unit 20 when the sliding stair unit 30 descends.

In this case, a locking device 26 is configured at one side of the safety fence unit 20 and will be described with reference to FIG. 4.

The locking device 26 is extended in the longitudinal direction of the safety fence unit 20 and has locking protrusions (not illustrated) at predetermined intervals, and in this case, the locking protrusions are fitted to a locking portion 31*a* formed at one side of the sliding fence 31 and then separated from the locking portion 31*a* to unfold the fence unit 1.

In detail, the present invention will be described with reference to FIGS. 8 and 9.

FIGS. 8 and 9 are exemplary views illustrating another operating state according to the present invention.

Accordingly, a push unit 50 is configured to move up and down at one side of the entrance unit 10 and a punch unit 60 is configured at one side of the sliding stair unit 30.

Further, referring to FIGS. 8 and 9, a control unit 40 is formed at one side of the entrance unit 10, and the control unit 40 has a grip (not illustrated) formed at one end thereof and a ring (not illustrated) formed at the other end thereof and connects the ring and the aforementioned locking protrusion through a wire w.

Meanwhile, the wire w connects the locking protrusion and the push unit 50 and may be further included separately from the wire w connecting the ring and the locking protrusion.

Accordingly, the wire w is pulled by pulling the control unit 40 to pull the locking protrusions provided in the locking device 26, and as a result, the locking protrusions and the sliding fence 31 are separated from each other and finally, the sliding stair unit 30 descends.

At this time, in addition to the operation of pulling the control unit 40, the push unit 50 may be pressed to pull the wire w connected to the push unit 50 and pull the locking unit 26.

Due to the two wires w, the locking device 26 may operated by operating both the push unit 50 and the control unit 40, and in this case, the escape device according to the present invention may also be prevented from operating by the operation of the push unit 50 of infants or children.

Meanwhile, although described below through FIG. 7, the escape devices according to the present invention are continuously installed on a plurality of floors, and as a result, while the punch unit 60 at the upper side descends by the descending of the sliding stair unit 30, the escape devices continued on the plurality of floors may also be sequentially unfolded by hitting the push unit 50 at the lower side.

Further, the support portion 23 to easily unfold and support the safety fence 22 in the case of emergency such as firing includes a support bar 23*a* configured in a scissor form in which a pair of bars are hinge-coupled, a coupling hinge 23*b* which is coupled to the fastening frame 21 and a part of the upper portion of the safety fence 22, respectively, so that one end of the support bar 23*a* is rotatable, and a transfer hinge 23*c* by which the other end of the support bar 23*a* is extrapolated into the guide rod 24 provided at the fastening frame 21 and one side of the safety fence 22 to be hinge-coupled to be movable.

When the transfer hinge 23*c* moves along the guide rod 24 to be supported when the scissor-shaped support bar 23*a* is unfolded, and an elastic member 24*b* is further included at one side of the guide rod 24. When folding, the transfer hinge 23*c* presses the elastic member 24*b*, and when unfolding, the transfer hinge 23*c* is transferred upward by the pressed elastic force to be easily unfolded (see FIG. 5).

The sliding stair unit 30 configured above has a pair of sliding fences 31 and folding stairs 32 provided inside the sliding fences 31, and the pair of the sliding fences 31 are coupled to the safety fence 22 and the fastening fence 21, respectively, to be unfolded together with the unfolding operation of the safety fence unit 20.

At this time, the folding stairs 32 hinge-coupled to the lower ends of the pair of sliding fences 31 is unfolded, and the folding stairs 32 are folded by hinging one ends of a pair of the panels and serves as stairs during unfolding.

In addition, the sliding fence 31 spaced apart from the outer wall of the building of the pair of sliding fences 31 further has vertical bars to prevent the escaping person from falling down.

The plurality of integrated folding safety handrail and outdoor escape stairs of the present invention are combined and installed on the outer wall of the high-rise safety fence in addition to the safety fences of high-rise multi-family houses, high-rise office buildings, and high-rise outdoor sports facilities.

To this end, an installation example according to the present invention will be described below in detail below with reference to FIG. 7 which is an exemplary view.

FIG. 7 is an exemplary view for illustrating an installation example according to the present invention.

The integrated folding safety handrail and outdoor escape stairs of the present invention maintain a downward stair form of the safety fence of high-rise multi-family houses, high-rise office buildings, or high-rise outdoor sports facilities and the high-rise safety fence and serve as an emergency escape device.

More specifically, the integrated folding safety handrail and outdoor escape stairs are normally in a folded state A and applied as a fall prevention handrail and then unfolded in the case of emergency such as firing and applied as the emergency escape device.

In this case, the locations of the entrance units 10 are alternately arranged for each floor. For example, the plurality of integrated folding safety handrail and outdoor escape stairs are alternately arranged for each floor so that the entrance unit 10 is located at the left side of the outer wall of the building and the safety fence unit 20 and the sliding stair unit 30 are arranged at the side adjacent to the entrance unit 20 in a right downward stair form, and on the next floor, the entrance unit 10 is located at the right side of the outer wall of the building and the safety fence unit 20 and the sliding stair unit 30 are arranged in a left downward form.

Herein, the plurality of integrated folding safety handrail and outdoor escape stairs are alternately arranged for each floor as described above so that the stairs are arranged downward when the escaping person moves from the high floor to the lower floor in the high-rise building. In addition, the entrance unit 20, the safety fence unit 20, and the sliding stair unit 30 are separately provided and assembled before the site installation to complete the integrated folding safety handrail and outdoor escape stairs, thereby implementing a complicated emergency escape device.

By the above implementing method, it is possible to shorten the time required for the site installation, implement the left-down type and the right-down type which are different in shape, and solve the inconvenience of separately manufacturing each part according to the type.

What is claimed is:

1. An emergency escape device used as integrated folding safety handrail and outdoor escape stairs, the emergency escape device comprising:

a fence unit in which an entrance unit and a safety fence unit are integrated; and a sliding stair unit provided inside the safety fence unit and installed so that escape stairs are unfolded to slide downward to escape, wherein the entrance unit is installed on an outside of a high-rise building to be unfolded and protrude to form an escape space on an outer wall of the building in order to escape to the outside of the building, the emergency escape device is normally used as a handrail for falling prevention and used for evacuation and escape in case of emergency such as fire, and the safety fence unit is extended from the entrance unit and unfolded to form the space to escape downward and includes a fastening plate coupled to the outer wall of the building, a safety fence corresponding to the fastening plate and provided to be unfolded and spaced apart from the outer wall of the building, a support portion provided on a side opening portion of the safety fence and the fastening plate, guide rods are provided so that the support portion may move when the safety fence is unfolded, and a hinge bar is provided at an upper side of the safety fence and the fastening plate, the support portion unfolds and support the safety fence in the case of emergency and includes a pair of support bars configured in a scissor form in which the pair of support bars are hinge-coupled, coupling hinges are coupled to the fastening frame and a part of the upper portion of the safety fence, respectively, so that one end of the support bars are rotatable, and transfer hinges by which the other end of the support bars are extrapolated into the guide rods provided at the fastening frame and one side of the safety fence to be hinge-coupled to be movable.

2. The emergency escape device of claim 1, wherein the entrance unit includes a coupling frame attached on the outer wall of the building, a fence plate corresponding to the coupling frame, and a folded fence coupled to the fence plate and one side of the coupling frame and further includes a folding footplate coupled to an inner lower end of the entrance unit.

3. The emergency escape device of claim 2, wherein the folding fence has a hinge at the center and is formed so that a pair of rectangular frames are coupled to each other at the hinge and a folding downward stair is coupled to each rectangular frame, so that an escaping person may move downward when the escaping person escapes downward from the upper floor to the lower floor of high-rise building.

4. The emergency escape device of claim 1, wherein the safety fence unit includes a locking device extended in a longitudinal direction of the safety fence unit and further includes locking protrusions formed at predetermined intervals.

5. The emergency escape device of claim 1, wherein the sliding stair unit is configured by coupling a pair of sliding fences and a folding stair provided inside the sliding fence, and a folding fence provided on an opened surface of the pair of sliding fences and a locking portion provided on one side of the sliding fences.

6. The emergency escape device of claim 5, wherein the folding fence is formed by a pair of hinged rectangular frames, and a plurality of horizontal bars is formed in a ladder shape in the pair of rectangular frames, respectively, and the horizontal bar for preventing the escaping person from falling out of the opened surface of the pair of sliding fences.

7. The emergency escape device of claim 1, wherein the transfer hinge moves along the guide rod when the scissor-shaped support bar is unfolded, and an elastic member is further included at one side of the guide rod, and when folding, the transfer hinge presses the elastic member, and when unfolding, the transfer hinge is transferred upward by the pressed elastic member to be easily unfolded.

8. The emergency escape device of claim 1, wherein a control unit for unfolding the emergency escape device is provided at one side of the entrance unit.

9. The emergency escape device of claim 1, wherein a push unit is configured at one end of the entrance unit and a punch unit is configured at one end of the safety fence unit.

10. The emergency escape device of claim 1, wherein a control unit and a locking device are connected to each other by a wire, and the wire is pulled by pulling the control unit to pull the locking device and then, while a locking protrusion and a locking portion are separated from each other, the sliding stair unit descends.

11. The emergency escape device of claim 10, wherein when the fence units and the sliding stair units are installed on a plurality of floors, the locations of the entrance units are alternately arranged for each floor, and when the sliding stair unit at an upper floor descends, a punch unit configured in the sliding stair unit hits a push unit configured in the entrance unit to unfold the fence unit and the sliding stair unit at a lower floor and then the fence units and the sliding stair units at the plurality of floors are continuously unfolded.

12. The emergency escape device of claim 2, wherein a control unit and a locking device are connected to each other by a wire, and the wire is pulled by pulling the control unit to pull the locking device and then, while a locking protrusion and a locking portion are separated from each other, the sliding stair unit descends.

13. The emergency escape device of claim 12, wherein when the fence units and the sliding stair units are installed on a plurality of floors, the locations of the entrance units are alternately arranged for each floor, and when the sliding stair unit at an upper floor descends, a punch unit configured in the slide stair unit hits a push unit configured in the entrance unit to unfold the fence unit and the sliding stair unit at a lower floor and then the fence units and the sliding stair units at the plurality of floors are continuously unfolded.

14. The emergency escape device of claim 4, wherein a control unit and the locking device are connected to each other by a wire, and the wire is pulled by pulling the control unit to pull the locking device and then, while a locking protrusion and a locking portion are separated from each other, the sliding stair unit descends.

15. The emergency escape device of claim 14, wherein when the fence units and the sliding stair units are installed on a plurality of floors, the locations of the entrance units are alternately arranged for each floor, and when the sliding stair unit at an upper floor descends, the punch unit configured in the sliding stair unit hits a push unit configured in the entrance unit to unfold the fence unit and the sliding stair unit at a lower floor and then the fence units and the sliding stair units at the plurality of floors are continuously unfolded.

16. The emergency escape device of claim 5, wherein a control unit and a locking device are connected to each other by a wire, and the wire is pulled by pulling the control unit to pull the locking device and then, while a locking protrusion and a locking portion are separated from each other, the sliding stair unit descends.

17. The emergency escape device of claim 16, wherein when the fence units and the sliding stair units are installed on a plurality of floors, the locations of the entrance units are alternately arranged for each floor, and when the sliding stair unit at an upper floor descends, a punch unit configured in the sliding stair unit hits a push unit configured in the entrance unit to unfold the fence unit and the sliding stair unit at a lower floor and then the fence units and the sliding stair units at the plurality of floors are continuously unfolded.

18. The emergency escape device of claim 8, wherein the control unit and a locking device are connected to each other by a wire, and the wire is pulled by pulling the control unit to pull the locking device and then, while a locking protrusion and a locking portion are separated from each other, the sliding stair unit descends.

19. The emergency escape device of claim 18, wherein when the fence units and the sliding stair units are installed on a plurality of floors, the locations of the entrance units are alternately arranged for each floor, and when the sliding stair unit at an upper floor descends, a punch unit configured in the sliding stair unit hits a push unit configured in the entrance unit to unfold the fence unit and the sliding stair unit at a lower floor and then the fence units and the sliding stair units at the plurality of floors are continuously unfolded.

20. The emergency escape device of claim 9, wherein a control unit and a locking device are connected to each other by a wire, and the wire is pulled by pulling the control unit to pull the locking device and then, while a locking protrusion and a locking portion are separated from each other, the sliding stair unit descends.

* * * * *